US005314082A

United States Patent [19]

Konop

[11] Patent Number: 5,314,082

[45] Date of Patent: May 24, 1994

[54] SENSING DEVICE FOR INDICATING IMPROPER ORIENTATION OF A HOIST LIFTING LINE

[75] Inventor: Jeffrey A. Konop, Grafton, Wis.

[73] Assignee: Harnischfeger Corporation, Brookfield, Wis.

[21] Appl. No.: 14,325

[22] Filed: Feb. 5, 1993

[51] Int. Cl.[5] ..... B66C 13/06

[52] U.S. Cl. ..... 212/147; 212/153

[58] Field of Search ..... 212/146, 147, 149, 153, 212/154

[56] References Cited

U.S. PATENT DOCUMENTS 4 042,214 8/1977 Brener ..... 254/186
4,471,877 9/1984 Whitly ..... 212/147

FOREIGN PATENT DOCUMENTS 2316810 10/1973 Fed. Rep. of Germany ..... 212/147
3445830 6/1986 Fed. Rep. of Germany ..... 212/153
1211606 2/1986 U.S.S.R. ..... 212/146

*Primary Examiner*—Michael S. Huppert
*Assistant Examiner*—Thomas J. Brahan
*Attorney, Agent, or Firm*—Michael, Best & Friedrich

[57] ABSTRACT

An overhead crane comprising a frame, a hoist mounted on the frame, the hoist including a lifting rope, and a device for detecting a side pull condition of the lifting rope.

16 Claims, 3 Drawing Sheets

SENSING DEVICE FOR INDICATING IMPROPER ORIENTATION OF A HOIST LIFTING LINE

BACKGROUND OF THE INVENTION

The present invention relates to hoist mechanisms having a hoist lift line and upper and bottom sheave blocks that can become vertically misaligned.

An overhead crane includes a trolley supported by wheels for movement on elevated rails. The trolley has a frame on which a hoist mechanism is mounted. The hoist includes a rotatable hoist lift drum driven by a prime mover. A main lift line such as a rope, usually fabricated of wire, is connected to the lift drum for raising and lowering a load in response to a control actuated by an operator. The wire rope is reeved through upper and bottom sheave block assemblies, and a lifting hook is secured to the bottom sheave block. An operator station is located on the crane high above the floor.

For proper lifting of a load the bottom sheave block must be vertically aligned with the upper sheave block so as to be directly underneath it when the load is lifted. When hitching up a load, the rigger can easily pull the lift hook laterally and move the bottom sheave block out of its desired vertical alignment with the upper sheave block. This condition is generally referred to as "side pull". If side pull exists the load will abruptly swing laterally to a plumb position when it loses contact with the floor. Side pull can result in damage to the load, to the hoist and to adjacent structure as well as possible injury to workers. The operator, from a position high above the factory floor, finds it very difficult to determine if a side pull condition exists.

SUMMARY OF THE INVENTION

A need exists for a simple, reliable, low cost sensing device that will instantaneously warn the crane operator of side pull before a load is actually lifted. The present invention provides a sensing device that warns the operator when side pull exists.

The sensing device includes a reference signal generating means such as a light source mounted on the trolley. The sensing device further includes a reference means or block that is located in a reference position when the lift rope is in its desired orientation (when no side pull exists). The reference block interacts with the lift rope so as to be moveable in response to deviation of the lift rope from its desired orientation. The reference block includes a reflector that intercepts and reflects the reference signal (the light beam) with the reflected light becoming an output signal. A detecting means is mounted on the trolley and generates a control signal when the output signal (the reflected light) is sensed or received. The detecting means is located so that the reflected light is only sensed when the rope is in the desired orientation. Thus the control signal is generated by the detecting means only when the lift rope is in its desired orientation. An indicator means is connected to the detecting means and signals the operator when the rope is not in its desired orientation, i.e., when the control signal is not received.

Figure 1:
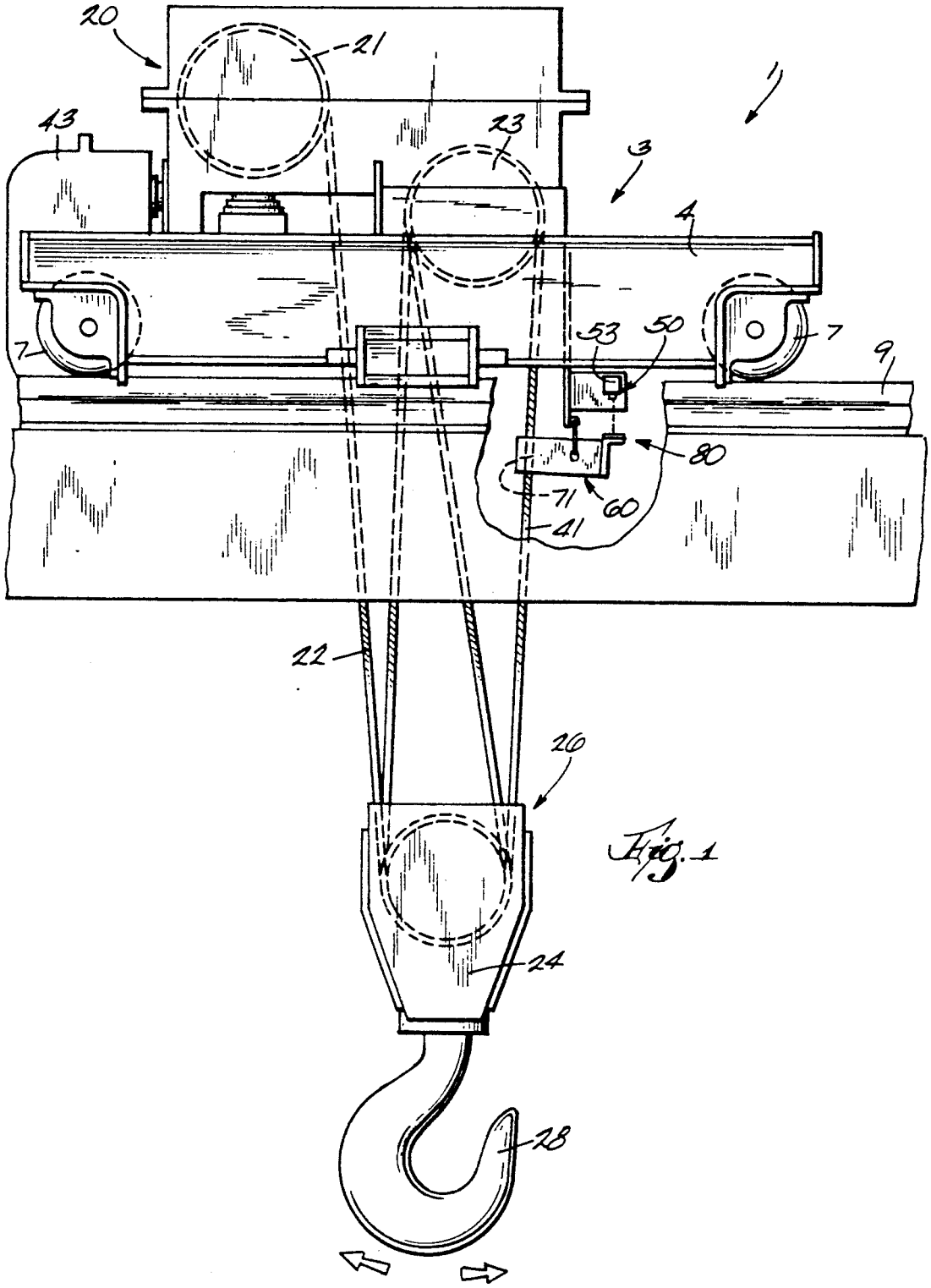
FIG. 1 is a side elevational view of a crane trolley having a hoist mechanism incorporating the sensing device of the present invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in FIG. 1 is an overhead crane 1 comprising a sensing device 2. It should be understood that the sensing device 2 could be embodied in any type of hoist mechanism using a laterally shiftable lift rope. The overhead crane 1 includes a main trolley 3 having a frame 4. The trolley frame 4 is supported on wheels 7 which permit movement along spaced apart rails 9. A hoist mechanism 20 is mounted on the frame 4 for travel with the trolley 3. The crane trolley 3 is moved along rails 9 to place the hoist mechanism 20 above a load (not shown) that is to be lifted.

Figure 4:
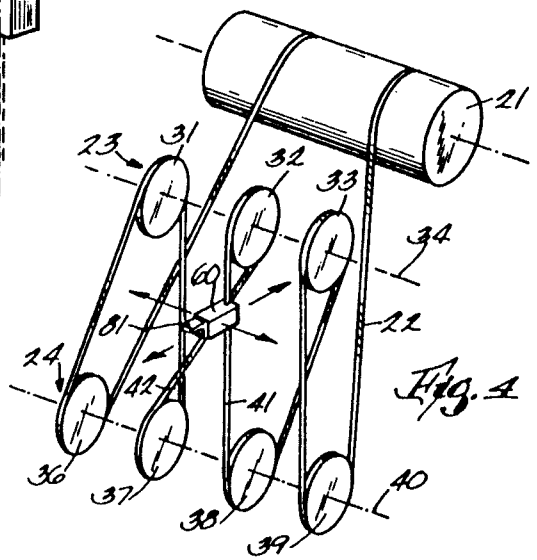
FIG. 4 is a schematic view of the lift rope reeving arrangement for the upper and bottom sheave assemblies of the hoist with the sheave block housings and lift hook not shown for purposes of clarity.

Referring to FIGS. 1 and 4, the hoist mechanism 20 generally comprises: a rotatable hoist drum 21; a main lifting element such as a wire rope 22 connected to the hoist drum 21 and reeved to run through upper and bottom sheave block assemblies 23 and 24 of a block and tackle 26; and a load lifting hook 28 connected to bottom block 24. More specifically, the upper block assembly 23 includes (see FIG. 4) upper outer sheaves 31, 33 and an equalizing sheave 32 mounted for rotation about upper axis 34. The bottom sheave assembly 24 includes lower sheaves 36, 37, 38 and 39 mounted for rotation about lower axis 40. The wire rope 22 includes equalizing rope runs 41 and 42 trained from equalizing sheave 32 to sheaves 38 and 37, respectively. The sheave 32 does not rotate and the runs 41, 42 do not move axially when the drum 21 rotates. The other sheaves 31, 32, 36, 37, 38, 39 rotate and the other runs move axially when the drum 21 rotates. The wire rope 22 is flexible and permits the lateral shifting of hook 28 in any direction as illustrated by the arrows in FIGS. 1 and 2. The hoist mechanism 20 further includes a conventional prime mover such as drive motor 43 connected through a gear train (not shown) in known manner for rotating the hoist drum 21.

Figure 2:
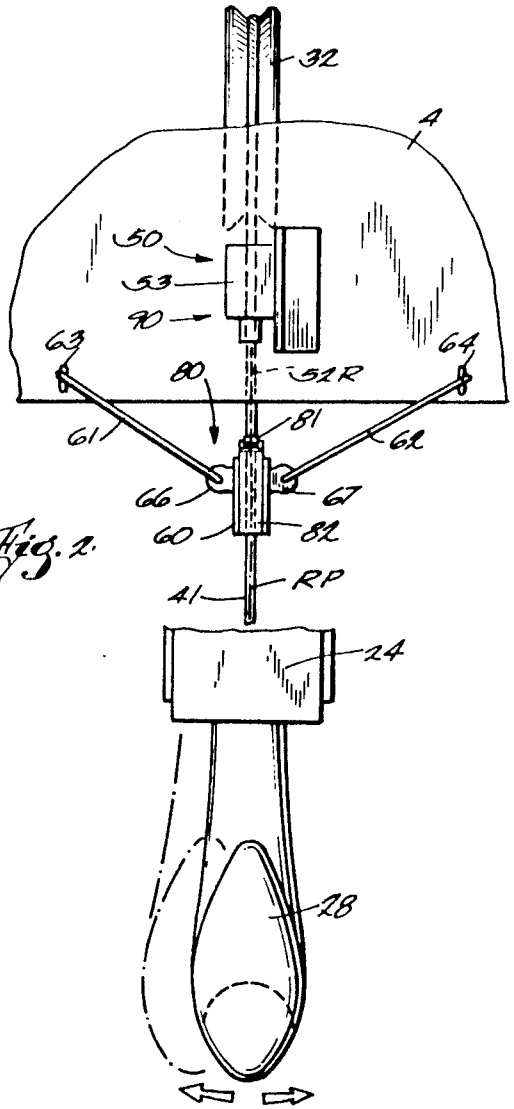
FIG. 2 is an enlarged, partial right side elevation view of the crane trolley shown in FIG. 1 illustrating the hoist lift rope in its desired orientation.
Figure 5:
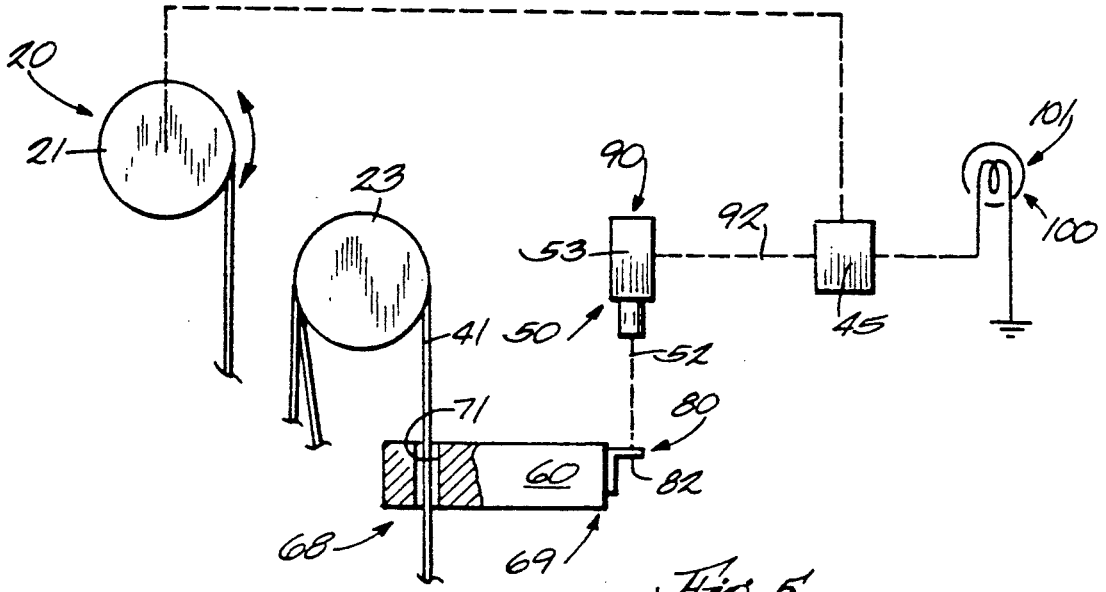
FIG. 5 is a schematic showing of the sensing device.

Referring to FIGS. 2 and 5, the crane 1 further includes a conventional operator's station (not shown) at which a conventional control (not shown) is located. A control circuit 45 (shown schematically in FIG. 5) operatively connects the operator control to hoist 20 and is operated in known manner to rotate hoist drum 21 to raise or lower the bottom sheave block assembly 24 relative to the top sheave block assembly 23.

Referring to FIGS. 1, 2, 3 and 5, a signal generating means 50 is mounted on trolley frame 4 to travel therewith and generate a reference signal 52. The signal generating means 50 is preferably a conventional photoelectric eye 53 that both emits a beam of light (the reference signal 52) and generates a control signal upon the return of the reflected beam of light.

Figure 3:
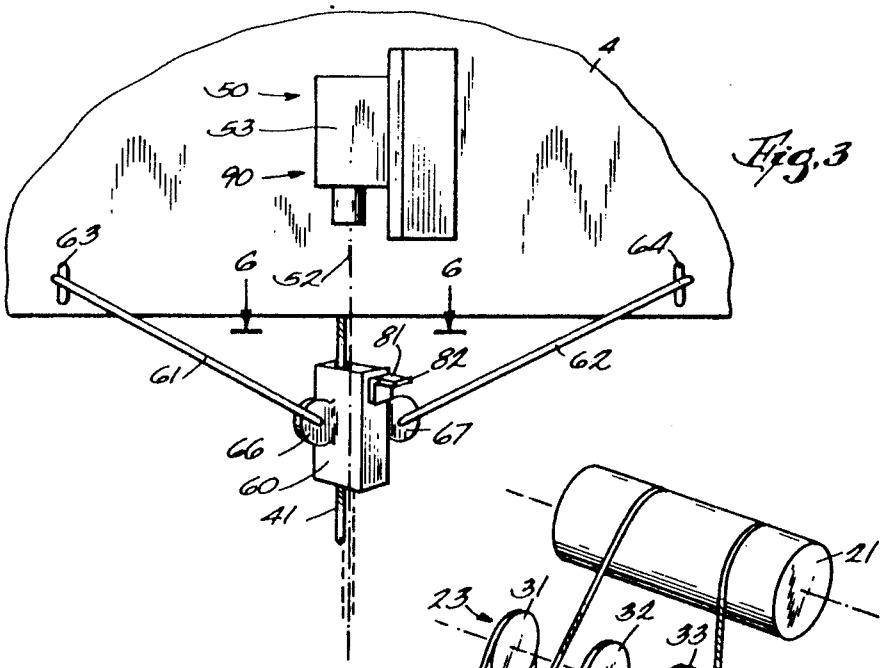
FIG. 3 is an enlarged portion of FIG. 2 showing the hoist lift rope deflected from its desired orientation.
Figure 6:
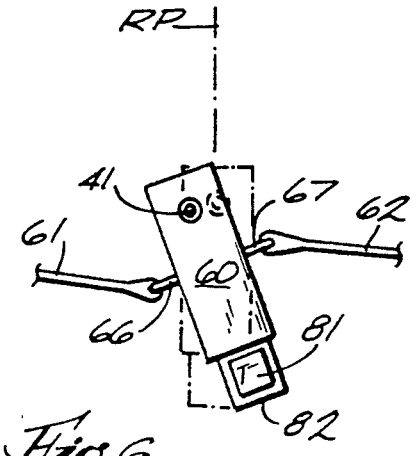
FIG. 6 is a view taken along line 6—6 in FIG. 3.

A reference means 60 is suspended from trolley frame 4 intermediate the upper and bottom sheave block assemblies 23 and 24. The reference means 60 is preferably a rectangular block suspended by stabilizing lines 61, 62 connected between eye bolts 63, 64 on the frame 4 and eye bolts 66, 67 on block 60 between the ends thereof. The block 60 is suspended for movement relative to a reference position RP (best illustrated in FIGS. 4 and 6). The block 60 has opposite ends 68, 69 and is provided with a follower or guide means that preferably comprises a bore 71 adjacent the end 68 of the block 60. One non-running equalizing rope run 41 is threaded through the bore 71. Movement of the bottom sheave block 24 from its desired position directly below upper block 23 moves the rope run 41 laterally and moves the block 60 from its reference position RP as illustrated in FIG. 3. The lines 61, 62 allow the end 68 of the block 60 to move laterally in any direction (as illustrated by arrows in FIG. 4) so as to move the block 60 away from the reference position RP in response to movement of bottom block 24 from its desired position directly beneath upper block 23, i.e., in response to a side pull condition. The block 60 can either pivot out of the reference position (as shown in FIG. 6) or move laterally out of the reference position (left or right in FIG. 1).

Referring to FIGS. 1–3 and 5, a receptor means 80 is mounted on the block 60 adjacent the end opposite the bore 71. The receptor means 80 preferably includes a reflector 81 mounted on an adjustable bracket 82 secured to the block 60. The angular position of the reflector 81 relative to the block 60 is set as required so that, when the block is in its reference position, the reflector 81 intercepts the light beam 52 and generates an output signal 52R (the reflected beam), as shown in FIG. 2.

Referring to FIG. 3, a detecting means 90 is mounted on trolley frame 4 to receive the light beam reflected from the reflector 81. The detecting means 90 is preferably the photoelectric eye 53, which is positioned so as to receive the reflected beam 52R when the block 60 is in its reference position. The photoelectric eye 53 sends a control signal 92 (FIG. 5) to the control circuit 45 in response to detection of the reflected light beam 52R. The control signal 92 can be, for example, either the presence or absence of an electric current.

While in the illustrated construction the signal generating means 50 and the detecting means 90 are a single device, i.e., the photoelectric eye 53, it should be understood that the signal generating means 50 and the detecting means 90 can be separate devices.

An indicator means 100 such as an indicator light 101 (shown in FIG. 5) is energized by the control circuit 45 when the control signal 92 is not generated by detecting means 90. The light 101 is positioned to be clearly visible to the crane operator.

In operation, as long as the bottom sheave block 24 remains vertically aligned below upper sheave block 23, i.e., when no side pull exists, the block 60 is maintained by wire rope run 41 in reference position RP and the light beam 52 is reflected from reflector 81 to cause the photoelectric eye 53 to generate the control signal 92 that keeps light 101 off. If the bottom sheave block 24 moves out of vertical alignment with the top sheave block 23, i.e., if side pull exists, the resultant movement of rope run 41 moves the block 60 from its reference position RP. This moves the reflector 81, causing the light beam 52 either to miss reflector 81 (as shown in FIG. 3) and not be reflected or to be reflected so as to miss photoelectric eye 53. In either event, the control signal 92 is not generated by the photoelectric eye 53. This turns the indicator light 101 on to alert the operator of the side pull condition. The operator can then adjust the position of trolley 3 until warning light 101 goes off, indicating that side pull no longer exists.

Various features of the invention are set forth in the following claims.

I claim:

1. A sensing device for indicating that a laterally shiftable lift element of a hoist has deviated from a desired orientation, said device comprising:

a signal generating means for generating a reference signal;

a reference means having a reference position when the lift element is at the desired orientation, said reference means including spaced apart ends and a receptor means mounted adjacent one of said ends to intercept said reference signal and generate an output signal in response to said reference signal when said reference means is in said reference position, and said reference means also including guide means mounted adjacent the other of said ends for contact with the lift element;

a mounting means pivotally connected to said reference means intermediate said spaced apart ends for securing said reference means to allow movement thereof from said reference position in response to deviation of the hoist lift element from the desired orientation; and a detecting means for generating a control signal in response to receipt of said output signal, said detecting means being positioned so as to receive said output signal from said reference means only when said reference means is in said reference position.

2. The sensing device according to claim 1 and further comprising an indicator means responsive to the absence of said control signal.

3. The sensing device according to claim 1 wherein:

said signal generating means generates a continuous reference signal;

said receptor means includes a reflector means aligned to normally reflect said continuous reference signal to said detecting means when said reference means is in said reference position; and movement of said reference means in response to said deviation of the lift element from the desired orientation causes said output signal to not be received by said detecting means.

4. The sensing device according to claim 1 wherein said reference means has therethrough a bore through which the lift element passes.

5. The sensing device according to claim 1 wherein said signal generating means and said detecting means comprise a photoelectric eye; and said reference signal is a light beam generated by said photoelectric eye.

6. The sensing device according to claim 1 wherein said mounting means includes a plurality of stabilizing lines for suspending said reference means from the hoist.

7. A hoist comprising:

a frame;

a rotatable hoist drum mounted on said frame;

a laterally shiftable lift element connected to depend from said drum at a desired orientation;

a prime mover operatively connected to selectively rotate said drum for raising and lowering said lift element; and a sensing device for indicating that said lift element has laterally shifted from said desired orientation, said device including a signal generating means for generating a reference signal, a reference means for intercepting said reference signal and generating an output signal, said reference means being supported by said frame independent of said lift element and said signal generating means for movement in response to deviation of said lift element, a detecting means for receiving said output signal and for generating a control signal in response to receipt of said output signal, said detecting means receiving said output signal only when said lift element is in said desired orientation, and an indicator means responsive to the absence of said control signal for indicating that said laterally shiftable lift element is not in said desired orientation.

8. The hoist according to claim 7 wherein a said reference means has thereon a reflector means for reflecting said reference signal as said output signal when said reference means is in a reference position, and wherein movement of said reference means in response to deviation of said lift element from said desired orientation causes said reflected output signal to not be received by said detecting means.

9. The hoist according to claim 8 wherein:

said reference means has spaced apart ends and a guide means;

said reflector means is mounted on said reference means adjacent one of said ends;

said guide means is mounted on said reference means adjacent the other of said ends for contact with said laterally shiftable lift element; and a mounting means is pivotally connected to said reference means intermediate said spaced apart ends.

10. The hoist according to claim 9 wherein said signal generating means and said detecting means comprise a photoelectric eye; and said reference signal is a light beam generated by said photoelectric eye.

11. The hoist according to claim 7 wherein said reference means is suspended from said frame by a plurality of stabilizing lines.

12. An overhead crane comprising a frame, means supporting said frame for horizontal movement, a hoist mounted on said frame, said hoist including a lifting rope having a desired orientation, a signal generating means for generating a reference signal, and means supported by said frame independent of said lifting rope and said signal generating means for detecting a side pull condition of said lifting rope, said detecting means having a reference position when the lifting rope is at the desired generation, and said detecting means intercepting said reference signal when in said reference position.

13. An overhead crane according to claim 12 wherein said hoist also includes a rotatable drum, an upper block, and a bottom block, wherein said rope is connected to said drum and reeved around said upper and bottom blocks such that said bottom block moves vertically in response to rotation of said drum, and wherein said detecting means detects when said bottom block is not directly beneath said upper block.

14. The overhead crane according to claim 12 wherein said detecting means is suspended from said frame by a plurality of stabilizing lines.

15. The overhead crane according to claim 14 wherein said detecting means includes spaced apart ends and a receptor means mounted adjacent one of said ends to intercept said reference signal and generate an output signal when said detecting means is in said reference position, and said detecting means also includes guide means mounted adjacent the other of said ends for contact with said lifting rope.

16. The overhead crane according to claim 15 wherein said guide means includes a bore through which said lifting rope passes.

* * * * *